US011278098B2

(12) United States Patent
Malkin

(10) Patent No.: US 11,278,098 B2
(45) Date of Patent: Mar. 22, 2022

(54) ENCAPSULATED HAIR BAND

(71) Applicant: Virginia Claire Malkin, Pittsburgh, PA (US)

(72) Inventor: Virginia Claire Malkin, Pittsburgh, PA (US)

( * ) Notice: Subject to any disclaimer, the term of this patent is extended or adjusted under 35 U.S.C. 154(b) by 531 days.

(21) Appl. No.: 16/395,114

(22) Filed: Apr. 25, 2019

(65) Prior Publication Data

US 2019/0357652 A1 Nov. 28, 2019

Related U.S. Application Data

(60) Provisional application No. 62/662,804, filed on Apr. 26, 2018.

(51) Int. Cl.

| | |
|---|---|
| ***A45D 8/36*** | (2006.01) |
| ***A41G 5/00*** | (2006.01) |
| *A45D 8/00* | (2006.01) |

(52) U.S. Cl.

CPC ..... *A45D 8/36* (2013.01); *A41G 5/0073* (2013.01); *A45D 8/002* (2021.01); *A45D 8/004* (2021.01)

(58) Field of Classification Search

CPC ..... A45D 8/36; A45D 8/002; A45D 8/004; A41G 5/0073

See application file for complete search history.

(56) References Cited

U.S. PATENT DOCUMENTS

| | | | | |
|---|---|---|---|---|
| 5,853,749 | A * | 12/1998 | Hobbs | A61L 26/008 424/443 |
| 10,905,215 | B1 * | 2/2021 | Silva | A45D 8/36 |
| 2007/0197949 | A1 * | 8/2007 | Chen | C09J 153/025 602/41 |
| 2010/0287965 | A1 * | 11/2010 | Bryant | F25D 7/00 62/259.3 |
| 2010/0319382 | A1 * | 12/2010 | Burrini | B65D 31/147 62/259.3 |
| 2012/0285480 | A1 * | 11/2012 | Howard | A45D 8/36 132/273 |

FOREIGN PATENT DOCUMENTS

| | | | | |
|---|---|---|---|---|
| WO | WO-2007104042 | A2 * | 9/2007 | A61M 16/0622 |

* cited by examiner

*Primary Examiner* — Amy R Weisberg
(74) *Attorney, Agent, or Firm* — Brian Samuel Malkin

(57) ABSTRACT

Encapsulated hair bands and methods for use are disclosed. An encapsulated hair band includes an encapsulated hair band, including: a horseshoe shaped hair band, having a proximal and distal end, the hair band including, flexible material capable of flexing outwardly whereby the proximal and distal ends may be displaced from an unbiased position to a biased position to fit about the wearer's head; a soft gel; and a cover, including two or more pieces, cooperating to form a cover, the two or more pieces fastened together so as to encapsulate said horseshoe shaped hair band and said soft gel, said soft gel encapsulated so that when the encapsulated hair band is placed upon the wearer's head, the soft gel is between the horseshoe shaped hair band and the cover.

20 Claims, 4 Drawing Sheets

ENCAPSULATED HAIR BAND

CLAIM FOR PRIORITY

This application claims priority to U.S. Provisional Application No. 62/662,804 filed on Apr. 26, 2018, the contents of which are fully incorporated by reference herein.

BACKGROUND

People use various hair accessories (i.e., head bands, hair bands, barrettes, and tiaras) to style and hold their hair. Such accessories are made of various materials, colors, and decorations. Once such hair accessory is a hair band, made of a flexible material shaped like a horseshoe and used to pull hair back behind the ears. Conventionally, such a hair band will contact the scalp at multiple pressure points and feel tight as it grips a wearer's head causing pain and discomfort when worn.

BRIEF SUMMARY

In summary, one aspect provides an encapsulated hair band, comprising: a horseshoe shaped hair band, having a proximal and distal end, said hair band comprising, flexible material capable of flexing outwardly whereby the proximal and distal ends may be displaced from an unbiased position to a biased position to fit about the wearer's head; a soft gel; and a cover, comprising two or more pieces, cooperating to form a cover, said two or more pieces fastened together so as to encapsulate said horseshoe shaped hair band and said soft gel, said soft gel encapsulated so that when the encapsulated hair band is placed upon the wearer's head, the soft gel is between the horseshoe shaped hair band and the cover.

Another aspect provides a method, comprising: the steps of: selecting an encapsulated hair band, comprising: a horseshoe shaped hair band, having a proximal and distal end, said hair band comprising, flexible material capable of flexing outwardly whereby the proximal and distal ends may be displaced from an unbiased position to a biased position to fit about the wearer's head; a soft gel; and a cover, comprising two or more pieces, cooperating to form a cover, said two or more pieces fastened together so as to encapsulate said horseshoe shaped hair band and said soft gel, said soft gel encapsulated so that when the encapsulated hair band is placed upon the wearer's head, the soft gel is between the horseshoe shaped hair band and the cover; grasping and flexing outwardly the distal and proximal ends; placing the encapsulated hair band on the wearer's head; and releasing the distal and proximal ends to return to the biased position to grip the wearer's head.

The foregoing is a summary and thus may contain simplifications, generalizations, and omissions of detail; consequently, those skilled in the art will appreciate the summary is illustrative and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

Embodiments describe that by covering a hair band in a cover that contains a soft gel-like material, pressure and pain points on the wearer's head are eliminated. The soft gel may include the additional feature of helping to keep the wearer's head a cool temperature while the hair band is worn.

The description now turns to the figures. The illustrated embodiments of the invention will be best understood by reference to the figures. The following description is intended only by way of example and simply illustrates certain selected exemplary embodiments of the invention as claimed herein.

Figure 1:
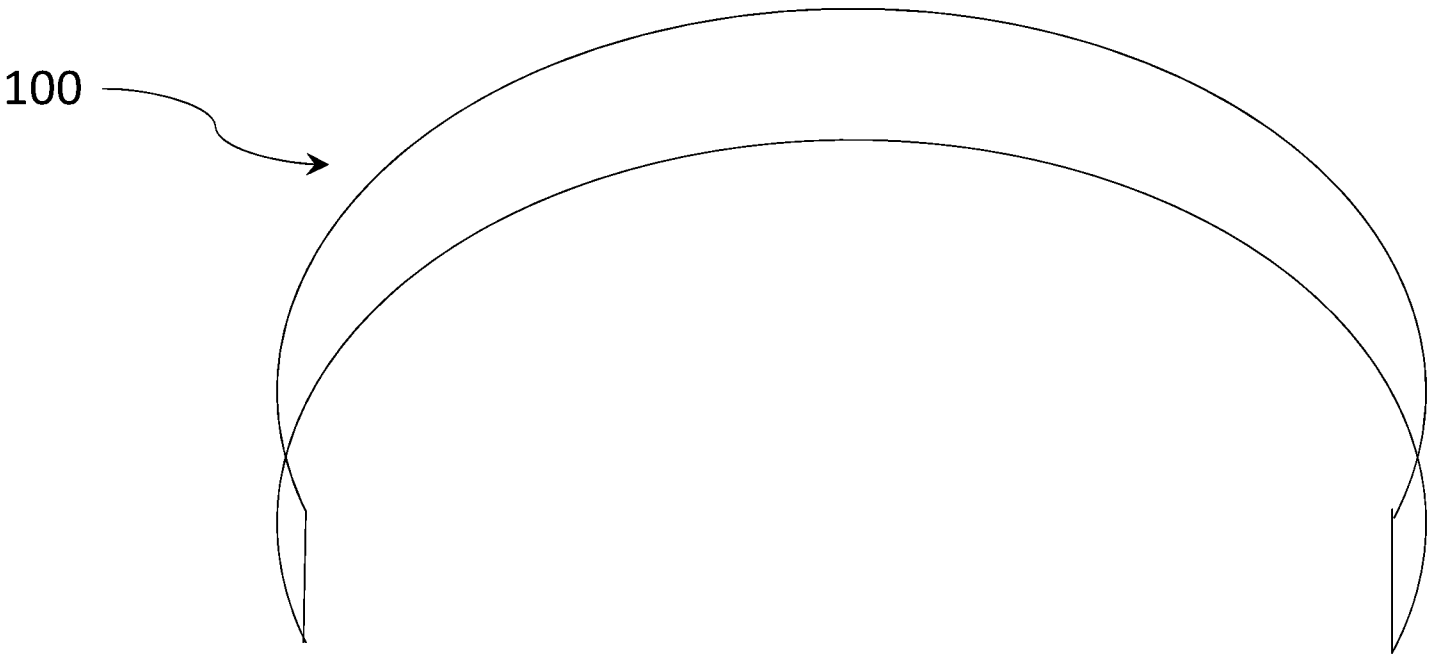
FIG. 1 illustrates an example embodiment.

FIG. 1 illustrates an example embodiment. Hair band 100 is a horseshoe shaped hair accessory having a proximal end 220 and distal end 240. Hair band 100 may be made of any flexible material suitable for biasing (springing) back into the original horseshoe shape for fitting on one's head. Such material may include but is not limited to molded plastic or metal. By covering the material of the hair band with a gel-filled casing, the pressure points and rigidity of the biasing flexible material is mitigated or neutralized because the gel filled casing contacts the user's head instead of the more unyielding biasing flexible material.

The hair band 100 described above may be fabricated from suitable rigid or flexible material. Embodiments provide that the hair band 100 may be made from a polymeric material manufactured via known injection molding techniques. Such a hair band may be adapted to flex outwardly whereby the free ends (proximal end 220 and distal end 240) may be displaced from an unbiased position to a biased position to fit about the wearer's head. Alternatively, the hair band may also be fabricated from a fabric, metal, or combinations thereof.

Figure 2:
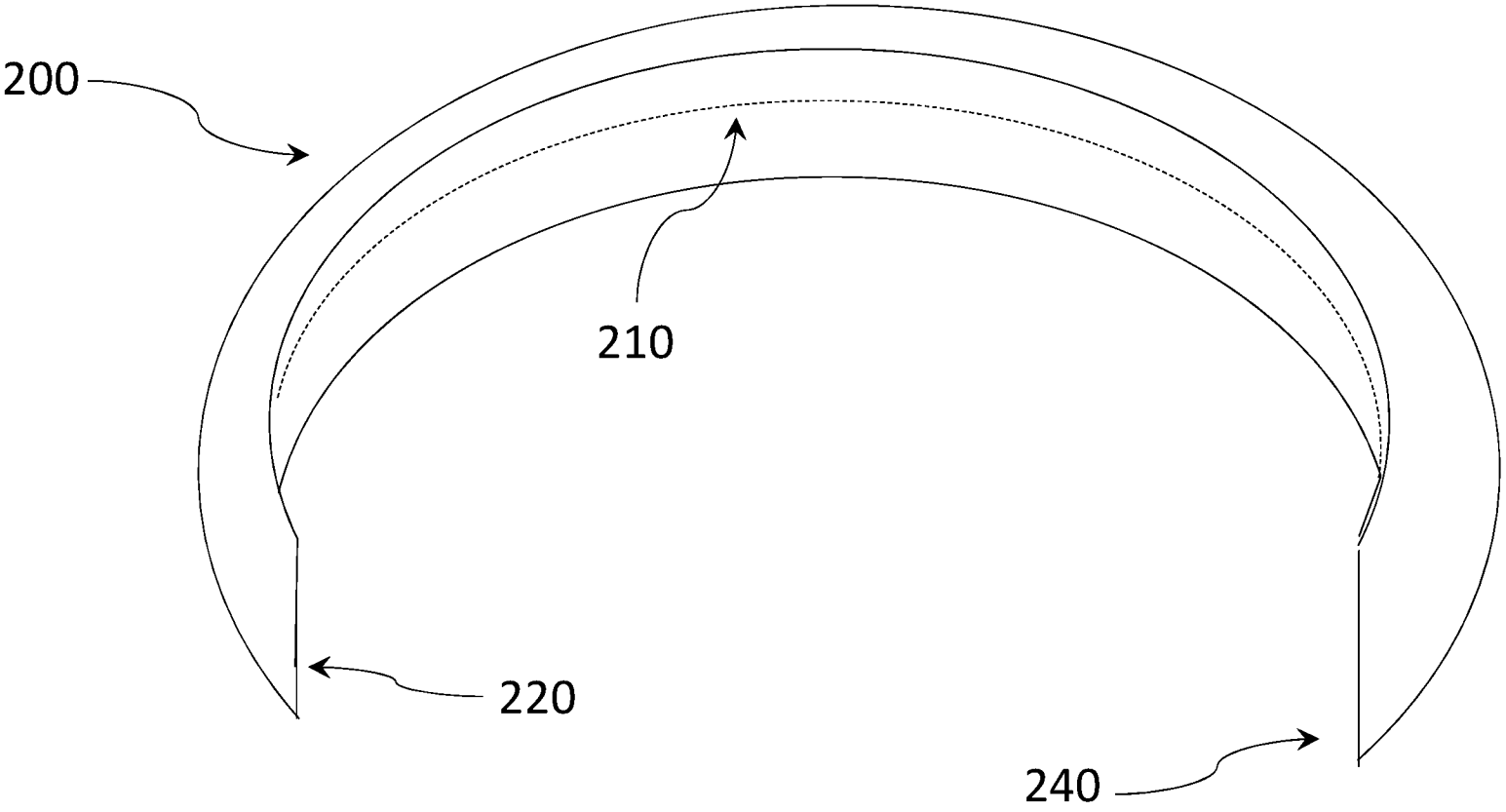
FIG. 2 illustrates an example embodiment.

Turning to FIG. 2, embodiments describe that hair band 100 may be encased in a soft gel filled cover 200. The soft gel may comprise silicone or polyurethane materials which may provide cooling properties. The soft gel may comprise hydro gels, polymer crystals, or water gels. A non-limiting example product suitable for embodiments is polyacrylamide crystals. Another non-limiting example of a suitable gel for embodiments is IsoGel®, a registered trademark of Pittsburgh Plastics Manufacturing of Butler, Pa. For example, embodiments describe that the Polyurethane (PU) IsoGel® manufactured by Pittsburgh Plastics Manufacturing may be inserted into the soft gel filled cover 200.

It will be appreciated that although embodiments have described using soft gel for cover 200, any appropriate and available material may be used and this disclosure contemplates all such materials and combinations, including, as non-limiting examples, visco-elastic, latex, and polyester.

Embodiments describe that in order to facilitate easy insertion and removal of hair band 100 into soft gel filled cover 200, the soft gel filled cover may comprise two or more pieces of a dimension to allow hair band 100 to be encased by soft gel filled cover 200. Soft gel filled cover 200 may comprise two or more pieces cooperating to create a cover and encapsulating both the hair band 100 and the soft gel filling. The two or more pieces of the soft gel filled cover 200 may be fastened together using any desirable fasteners, including, but not necessarily limited to, zipper, button, clasp, or hook and loop fasteners which close, for example, at 210. Other types of fastening mechanisms may also be used as appropriate. Embodiments describe that the two or more pieces cooperating to create a soft gel-filled cover 200 may simply be sewn or, in the case of polymer (or plastic) materials, heat sealed together to encapsulate both the gel filling and the rigid hair band.

Figure 3:
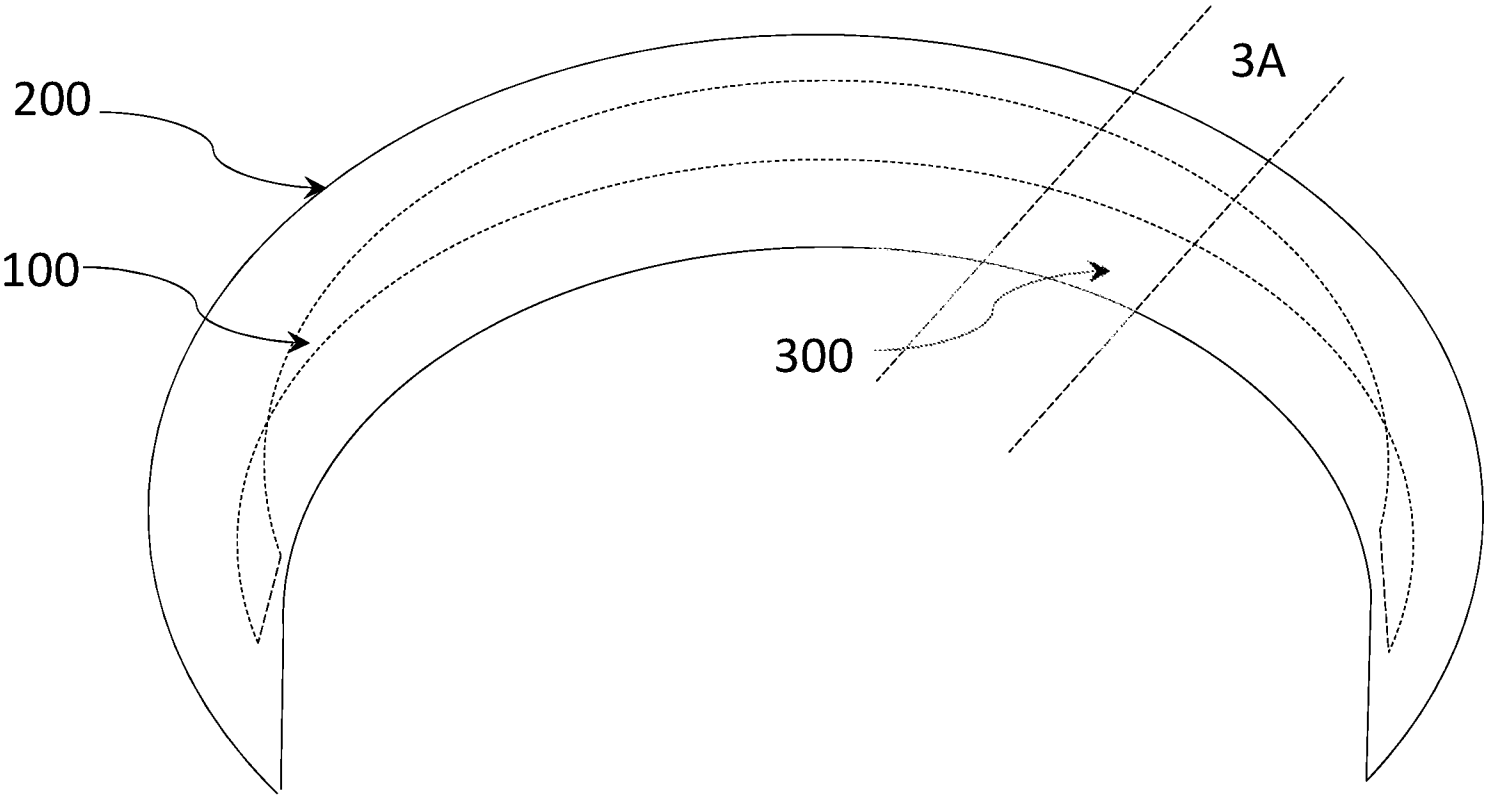
FIG. 3 is illustrates an example embodiment.

Now turning to FIG. 3, an example embodiment is depicted. Again, hair band 100 is encapsulated by cover 200. The soft gel filling may be inserted into the space 300 such that when the encapsulated hair band is worn, the gel filling is between the hair band 100 and the cover 200.

Figure 4:
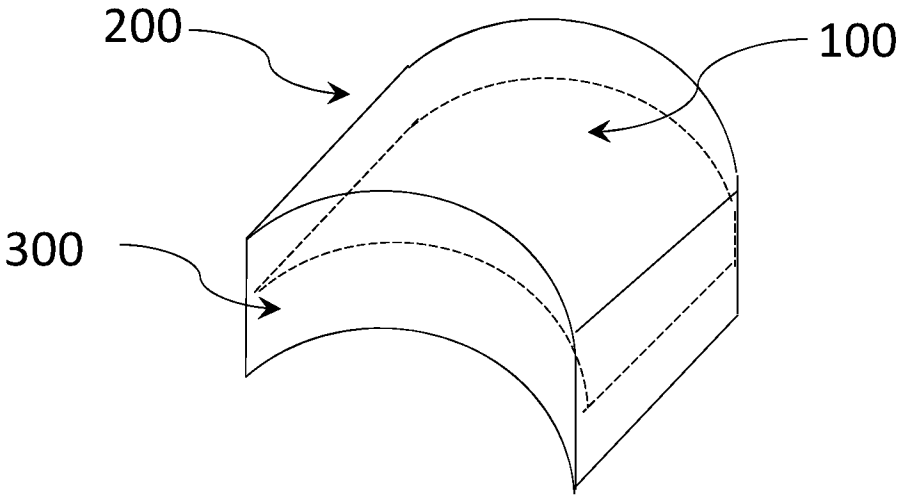
FIG. 4 is a magnified sectional view of an example embodiment.

In FIG. 4, shown is a magnified sectional view from 3A in FIG. 3, hair band 100 is encapsulated by cover 200. The soft gel filling may be inserted into the space 300 such that when the encapsulated hair band is worn, the gel filling is between the hair band 100 and the cover 200.

The exterior of the cover 200 may be ornamental or fashioned to be worn in public, for example, may have material that may have a woven, braided, or other ornamental design. The exterior of the cover 200 may also have any color, texture, or pattern thereon. The exterior of the cover 200 may also have accessories attached thereto, such as bows, jewels, and the like.

The exterior of the cover 200 may be decorated with external decorations, e.g., flowers, fabric, design, or other fashionably or other decorative relevant designs and elements and materials to be more aesthetically pleasing. In some embodiments, the body comprises one or more of a heart, insect, animal, flower, and other decorative shape. In further embodiments, the body comprises multiple designs. The discrete decorative elements may comprise anything which will decorate the wearer's hair and draw attention to the wearer. The decorative elements should be large enough to be noticeable but small enough to neither encumber the wearer nor to inhibit the appearance that they are independently attached to the wearer's hair. The decorative elements may be selected to cater to many styles, tastes and ages of wearer. For example, the decorative elements may include stones, gemstones, beads, miniatures, and miniature cartoon characters, figurines, letters, flowers, birds, insects and animals. They may be used on a variety of materials such as metal, stone, wood, or plastic, and maybe formed in a variety of colors. Mixtures of decorative elements either on different elongated members, or on the same member, may create particularly striking effects.

In a further embodiment, the hair band 100 may be applied to the head using a process comprising the following steps:

(1) hair band 100 is encased in soft gel filled cover 200;

(2) hair band 100 is flexed open such that it may be comfortably fit on the desired place on the user's head;

(3) hair band 100 is then fit on the desired place on the user's head; and (4) hair band 100 is permitted to spring back to its original shape such that it holds the user's hair.

While the various example embodiments have been described in connection with the examples provided herein, these were provided as non-limiting examples. Accordingly, embodiments may be used in similar contexts with similar devices and methods.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is non-limiting and that various other changes and modifications may be affected therein by one skilled in the art without departing from the scope or spirit of the disclosure.

What is claimed is:

1. An encapsulated hair band, comprising:

a horseshoe shaped hair band, having a proximal and distal end, said hair band comprising, flexible material capable of flexing outwardly whereby the proximal and distal ends may be displaced from an unbiased position to a biased position to fit about the wearer's head;

a soft-gel that completely surrounds and contains the horseshoe shaped hair band; and a cover, comprising two or more pieces, cooperating to form a cover, said two or more pieces fastened together so as to completely surround and contain said horseshoe shaped hair band and said soft-gel, such that when the encapsulated hair band is placed upon the wearer's head, the soft gel is between the horseshoe shaped hair band and the cover.

2. The encapsulated hair band of claim 1, wherein the soft-gel comprises silicone.

3. The encapsulated hair band of claim 1, wherein the soft-gel comprises polyurethane.

4. The encapsulated hair band of claim 1, wherein the soft-gel comprises hydro gels.

5. The encapsulated hair band of claim 1, wherein the soft-gel comprises polymer crystals.

6. The encapsulated hair band of claim 1, wherein the soft-gel comprises water gels.

7. The encapsulated hair band of claim 1, wherein the soft-gel comprises polyacrylamide crystals.

8. The encapsulated hair band of claim 1, wherein the two or more pieces are fastened together using a hook and loop fasteners.

9. The encapsulated hair band of claim 1, wherein the two or more pieces cooperating to create a cover comprise polymer materials.

10. The encapsulated hair band of claim 9, wherein the two or more pieces cooperating to create a cover are heat sealed together.

11. A method for using an encapsulated hair band comprising the steps of:

selecting an encapsulated hair band, comprising:

a horseshoe shaped hair band, having a proximal and distal end, said hair band comprising, flexible material capable of flexing outwardly whereby the proximal and distal ends may be displaced from an unbiased position to a biased position to fit about the wearer's head;

a soft-gel that completely surrounds and contains the horseshoe shaped hair band; and a cover, comprising two or more pieces, cooperating to form a cover, said two or more pieces fastened together so as to completely surround and contain said horseshoe shaped hair band and said soft-gel, such that when the encapsulated hair band is placed upon the wearer's head, the soft gel is between the horseshoe shaped hair band and the cover.

12. The method of claim 11, wherein the soft-gel comprises silicone.

13. The method of claim 11, wherein the soft-gel comprises polyurethane.

14. The method of claim 11, wherein the soft-gel comprises hydro gels.

15. The method of claim 11, wherein the soft-gel comprises polymer crystals.

16. The method of claim 11, wherein the soft-gel comprises water gels.

17. The method of claim 11, wherein the soft-gel comprises polyacrylamide crystals.

18. The method of claim 11, wherein the two or more pieces are fastened together using a hook and loop fasteners.

19. The method of claim 11, wherein the two or more pieces cooperating to create a cover comprise polymer materials.

20. The method of claim 19, wherein the two or more pieces cooperating to create a cover are heat sealed together.

* * * * *